US005625161A

United States Patent [19]

Nicolas et al.

[11] Patent Number: 5,625,161

[45] Date of Patent: Apr. 29, 1997

[54] SAFETY DEVICE FOR A SPIN STABILIZED PROJECTILE FUSE, PROCESS FOR MAKING SUCH A SAFETY DEVICE AND SPIN-STABILIZED FUSE HAVING SUCH A SAFETY DEVICE

[75] Inventors: Jacques Nicolas, Lecheix/Morge; Jean-Paul Oberle, Cusset, both of France

[73] Assignee: Manurhin Defense, Versailles, France

[21] Appl. No.: 491,871

[22] PCT Filed: Nov. 22, 1994

[86] PCT No.: PCT/FR94/01356

§ 371 Date: Jul. 10, 1995

§ 102(e) Date: Jul. 10, 1995

[87] PCT Pub. No.: WO95/16891

PCT Pub. Date: Jun. 22, 1995

[30] Foreign Application Priority Data

Dec. 17, 1993 [FR] France ..... 93 15203

[51] Int. Cl.[6] ..... F42C 15/23; F42C 15/22

[52] U.S. Cl. ..... 102/240; 102/234

[58] Field of Search ..... 102/234, 239, 102/240, 243, 252

[56] References Cited

U.S. PATENT DOCUMENTS

| | | | |
|---|---|---|---|
| 859,610 | 7/1907 | Meig's et al. | 102/240 |
| 3,516,359 | 6/1970 | Weber et al. | 102/240 |
| 4,938,139 | 7/1990 | Brede et al. | 102/240 |
| 5,147,974 | 9/1992 | Bai et al. | 102/240 |

FOREIGN PATENT DOCUMENTS

| | | | |
|---|---|---|---|
| 2429992 | 2/1980 | France | 102/240 |
| 2537265 | 6/1984 | France . | |
| 1197786 | 7/1963 | Germany . | |
| 2329944 | 1/1975 | Germany | 102/240 |

*Primary Examiner*—Harold J. Tudor
*Attorney, Agent, or Firm*—Oliff and Berridge

[57] ABSTRACT

A safety device to lock a firing pin of a spin-stabilized projectile fuse includes a flexible strip and a spiral spring. The flexible strip is disposed around the firing pin and has a first end, a second end and a length. The flexible strip is made of an elastic material. The spiral spring is windable around the flexible strip in a safe position and is disposed to unwind under centrifugal force to a firing position. The spiral spring is made of a spring strip that is wound around itself. When the spiral spring unwinds, the flexible strip unwinds within the spiral spring without exerting an elastic return force toward the firing pin. The length of the flexible strip is dimensioned such that the first end is offset in a circumferential direction relative to the second end by an offset amount when the flexible strip presses against the spiral spring in the firing position. As a result, the spin-stabilized projectile fuse functions reliably.

20 Claims, 6 Drawing Sheets

SAFETY DEVICE FOR A SPIN STABILIZED PROJECTILE FUSE, PROCESS FOR MAKING SUCH A SAFETY DEVICE AND SPIN-STABILIZED FUSE HAVING SUCH A SAFETY DEVICE

BACKGROUND OF THE INVENTION

The field of the present invention is that of safety devices intended for locking a firing pin for a fuse of a spin-stabilised projectile.

Projectiles, notably medium caliber shells, are fitted with safety devices intended to prevent initiation of the pyrotechnic circuit before firing and during the first few tens of meters of their trajectory.

A known safety device includes a lock, for example, a split sleeve, which immobilises the projectile firing pin in translation, and which is surrounded by a spiral spring consisting of an elastic strip wound upon itself.

German Patent DE1197786 describes such a safety device for a medium caliber projectile fuse.

The lock includes a strip folded back upon itself so as to form a sleeve with a hexagonal profile. The sleeve acts as a stop for a shoulder on the firing pin thus preventing the pin from striking a detonator.

Because of its split structure, the lock is able to open under the action of the centrifugal force exerted upon it during firing. The opening of the lock allows the firing pin to move in translation, for example, at impact on a target.

A spiral spring is wound around the lock. The function of the spiral spring is to delay the time at which the lock opens. Since this opening occurs only after a few tens of meters of trajectory, the gun crew is protected.

The centrifugal force which acts on the spring during firing thus causes it progressively to unwind and to wind up against the wall of a cylindrical housing in the fuse. Once thee spring is completely unwound, the lock can then open and release the firing pin.

Such a device has disadvantages. For example misfires have been observed because the spring can form unwanted loops which interfere with the firing pin and prevent it from moving freely.

SUMMARY OF THE INVENTION

The purpose of the invention is to propose a safety device not suffering from such drawbacks.

The safety device according to the invention ensures that, during firing, the spiral spring remains properly wound against its cylindrical casing without forming unwanted loops that prevent the firing pin from striking the detonator.

Thus, the purpose of the invention is a safety device intended to lock a firing pin for a spin-stabilised projectile fuse, the device including a spiral spring consisting of an elastic strip wound upon itself and held by its own elasticity around a locking device which maintains the firing pin in the safety position, the locking device having a flexible strip wound around the firing pin, the material and geometry of which are such that it exerts no elastic return force towards the firing pin, the length of the strip being such that, when it is unwound during firing following the spiral spring and applied against the spiral spring by the action of the centrifugal force, its ends overlap.

According to one embodiment of the invention, the flexible strip includes grooves, which are preferably orientated towards the firing pin.

The firing pin may then be cylindrical or have a polygonal section, preferably hexagonal.

The grooves may have a variable pitch allowing the strip to wind around the firing pin to form a polygonal shape.

If the firing pin has a polygonal section, the grooves of the strip will then be positioned, as it unwinds, at the corners of the polygon.

According to another characteristic of the invention, the strip is such that, once it has unwound following the spiral spring, its ends overlap on an arc of between 60° and 80°.

Another purpose of the invention is a process for producing such a device, the process including a step of manufacturing the grooves in the strip by knurling a smooth strip between a knurling wheel and a backing pulley.

Knurling can be done using a variable pitch knurling wheel.

In a variant, the strip may be pulled between the knurling wheel and the backing pulley by the rotation of a polygonal shaft on which the knurled strip winds up, this polygonal shaft being the firing pin.

BRIEF DESCRIPTION OF THE DRAWINGS

The invention will be better understood from the following description of particular embodiments with reference to the attached drawings on which:

With reference to FIGS. 1 and 2, a safety device 1 according to a first embodiment of the invention is intended to lock a firing pin 2 in a safe position in which it isi unable to strike a detonator (not shown).

Figure 1:
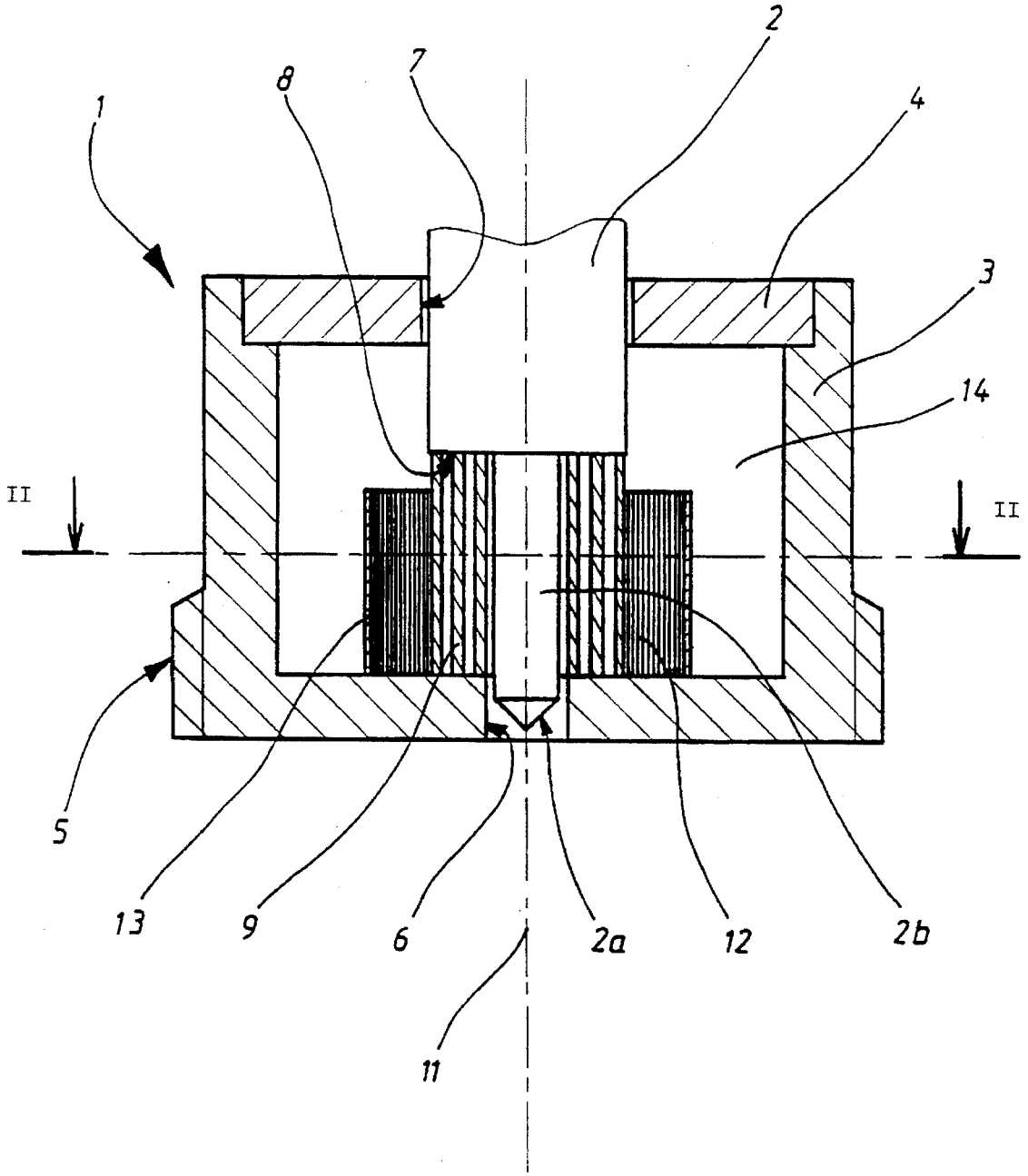
FIG. 1 is a schematic axial section of a safety device according to a first embodiment of the invention, the device being shown in the safe position.

The safety device consists of a cylindrical casing 3 closed by a cover 4 which is attached to the casing for example by screws (not shown).

The casing encloses an internal cylindrical space 14.

The casing is intended to be placed in a projectile fuse (not shown). It will be attached to the fuse by means of an external thread 5.

A hole 6 is drilled in the casing 3 to allow the point **2*a* of the firing pin 2 to penetrate and to fire the detonator. The cover has an opening 7 through which the firing pin 2 penetrates the casing 3**.

The firing pin 2 has a shoulder 8 which bears against a locking device or strip 9. As can be seen particularly clearly on FIG. 2, the strip 9 is a flexible piece that is spirally wound around a shank **2*b* integral with the firing pin 2. The strip 9 has grooves 10 parallel to one another and to the center line 11** of the device.

The strip 9 may be made of brass, beryllium copper, stainless or other steel, nickel, reinforced plastic material on the like. The material will be chosen according to the desired rigidity for retaining the firing pin 2 and the amplitude of the centrifugal forces developed when the projectile considered is fired.

The function of the grooves 10 is to give a degree of flexibility to the strip 9, allowing it to be wound around the shank **2*b* of the firing pin 2** and facilitating its unwinding by using the minimum energy.

In this way, it is possible to define a locking device that is both very strong (because of the substantial thickness of the strip) and very flexible because of the presence of the grooves.

Figure 2:
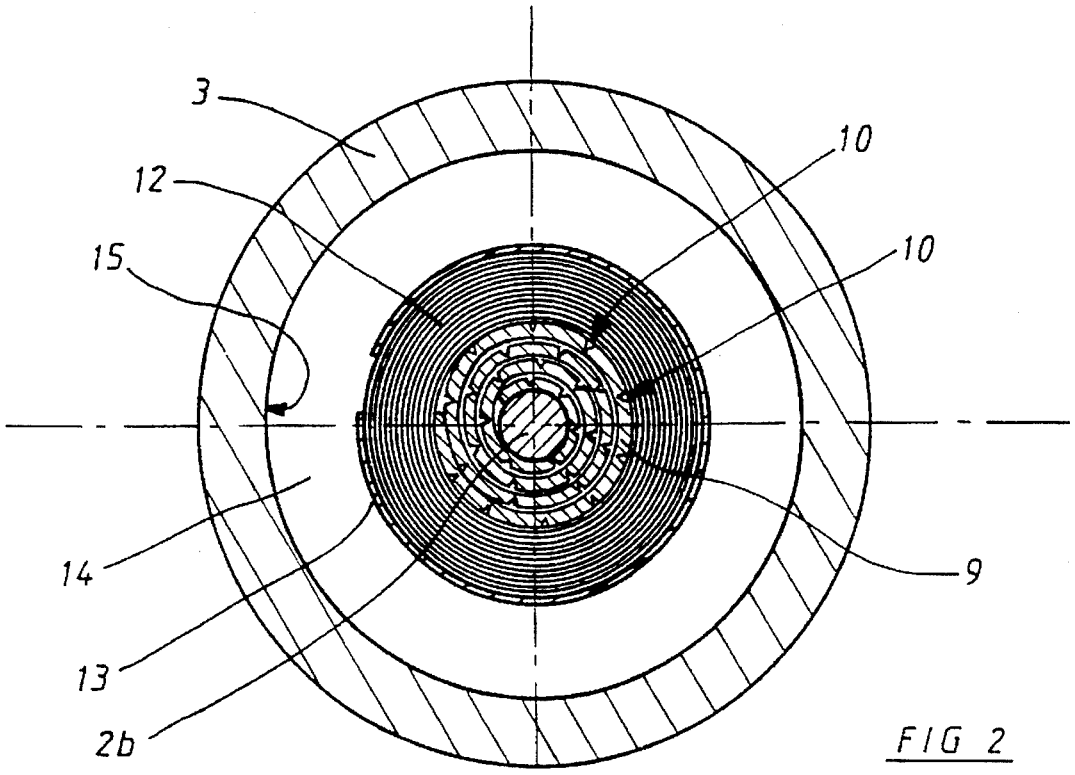
FIG. 2 is a transverse section of this device through the plane shown by the line II—II on FIG. 1.

The strip will also be defined in such a way that it exerts no elastic return force towards the firing pin both when wound as shown in FIGS. 1 and 2 and when unwound after firing, as will be described below.

The strip 9 is maintained in the firing pin locking position by a spiral spring 12 of a known type.

This spring is formed by an elastic brass strip wound upon itself and kept wound upon the strip 9 by its own elasticity. Other materials could be used for making the spiral: nickel, stainless steel, copper/beryllium, and the like. An elastic clip 13 made of steel or brass maintains the spiral spring 12 in its safe position shown on FIGS. 1 and 2, which prevents any accidental unwinding of the spiral when the projectile is exposed to vibration, for example, during transport.

In the embodiment described here, the strip 9 is wound on the shank **2*b* of the firing pin 2 in such a way that the grooves 10 face outwards, i.e., towards the spiral spring 12**.

Such an arrangement facilitates the winding of the strip on the firing pin, and in fact it is then the smooth surface of the strip which is in contact with the firing pin shank.

In a known manner, when the round is fired, the centrifugal inertial force first causes the clip 13, which is pressed against the inner cylindrical surface 15 of the space 14, to open.

The spiral spring 12 then unwinds progressively and winds up in a spiral against the inner cylindrical surface 16.

When the spiral spring 12 has completely unwound, the strip 9 then unwinds and winds up against the spiral spring.

The unwinding of the strip is facilitated by the presence of grooves which give flexibility even to a relatively thick strip.

Figure 3:
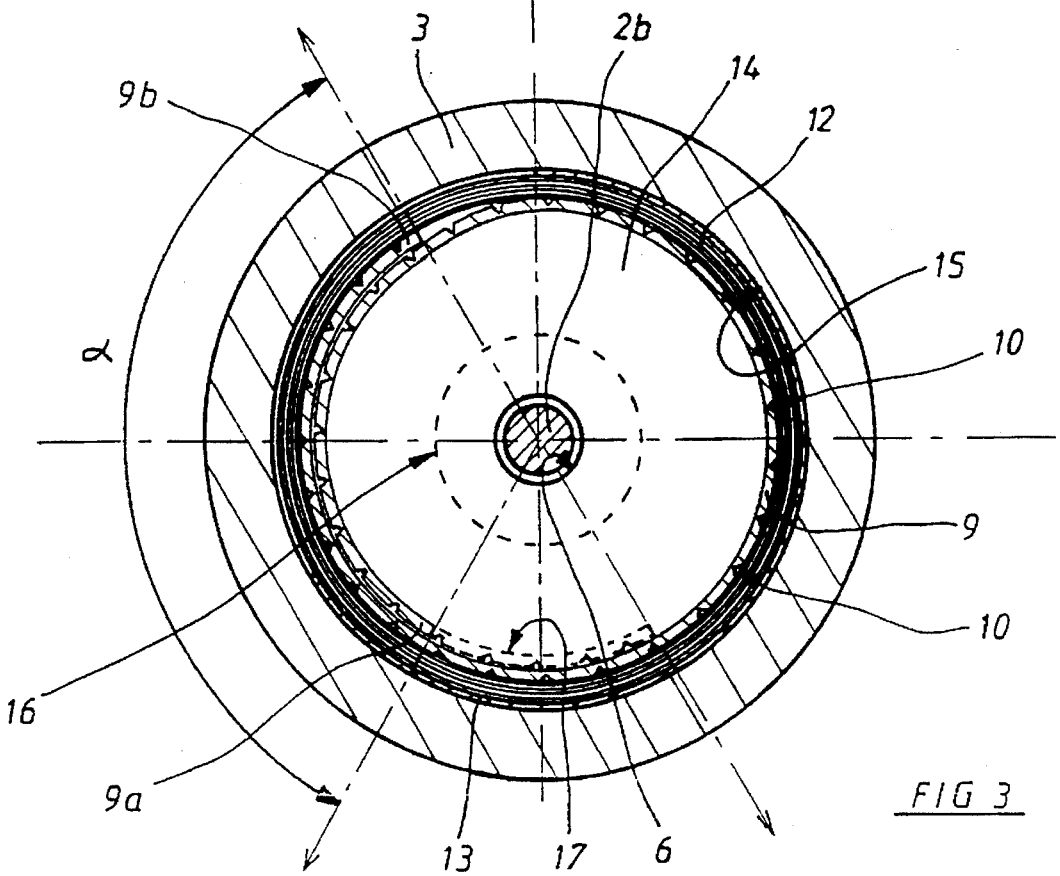
FIG. 3 is a similar view to FIG. 2, the device being shown in the unlocked position.

The device is then in the unlocked position shown in FIG. 3.

The diameter of the shoulder 8 of the firing pin is shown by the dotted circle 16. It can thus be seen that the strip 9 and the spiral 12 in the unlocked position show a winding diameter greater than the diameter of the shoulder 8. The shank of the firing pin 2 is then free to move into the hole 6.

FIG. 3 also shows that the length of the strip 9 is such that in the unlocked or firing position, its ends **9*a* and 9*b*** partially overlap over an arc subtending an angle $\alpha$ at the center.

This essential feature of the invention ensures that the spiral spring 12 is maintained in an arc of approximately 260° by the unwound strip 9.

In this way, the formation of unwanted loops on the spiral spring 12 is avoided. The formation of such loops is usually caused by friction on the spiral spring of a lock of the type described in German Patent DE1197786.

As a result of the invention, the overlapping of the ends of the strip ensures that the spring is maintained with a centrifugal force substantially equal in all radial directions. Hence, there is no relative slip between the strip and the spring and no formation of unwanted loops.

The strip 9 may be given a length such that the arc of overlap subtends an angle at the center of between 60° and 180°, the preferred angle being approximately 120°.

One end of the strip 9 giving an overlap over 180° has been shown as a dotted line 17.

Because the strip exerts no elastic return force towards the firing pin in the unlocked position, it has no unwanted curvature at its ends.

Since the strip does not exert an elastic return force towards thee firing pin in the wound-up position, it is therefore able to turn freely on the firing pin which facilitates the unwinding of the spiral and makes it possible to define a fuse whose firing pin is fixed in rotation.

Figure 4:
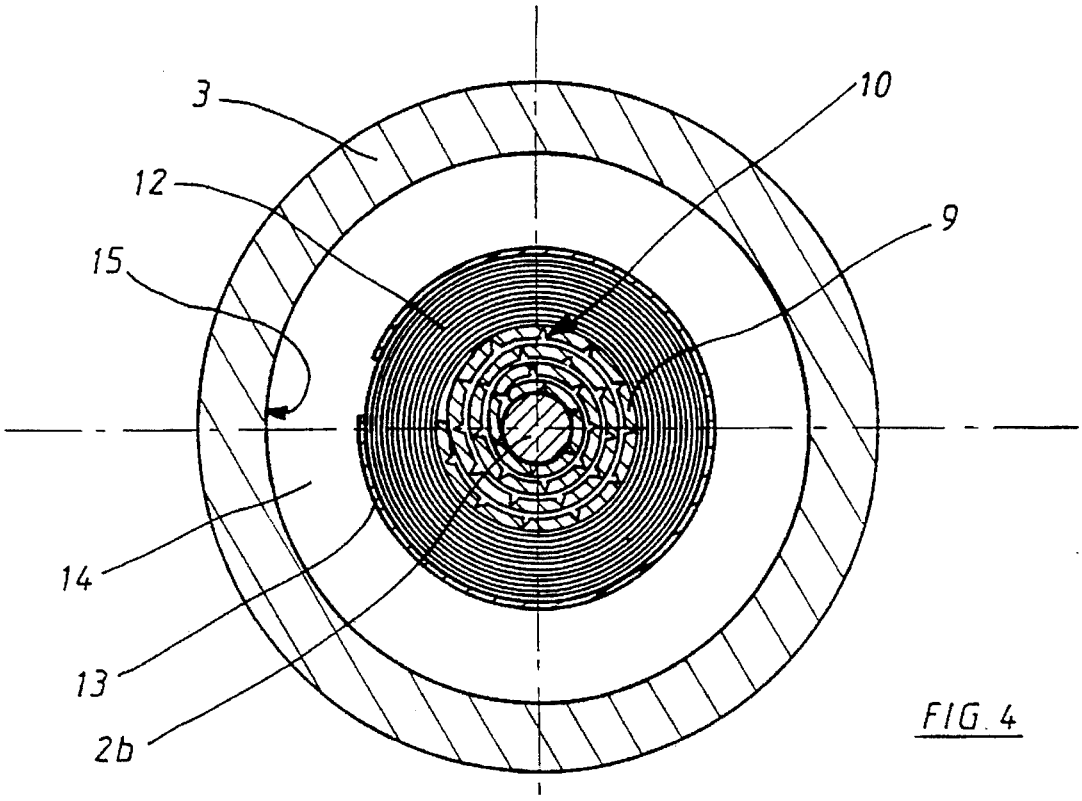
FIG. 4 is a transverse section of a variant embodiment of the invention in the safe position.
Figure 5:
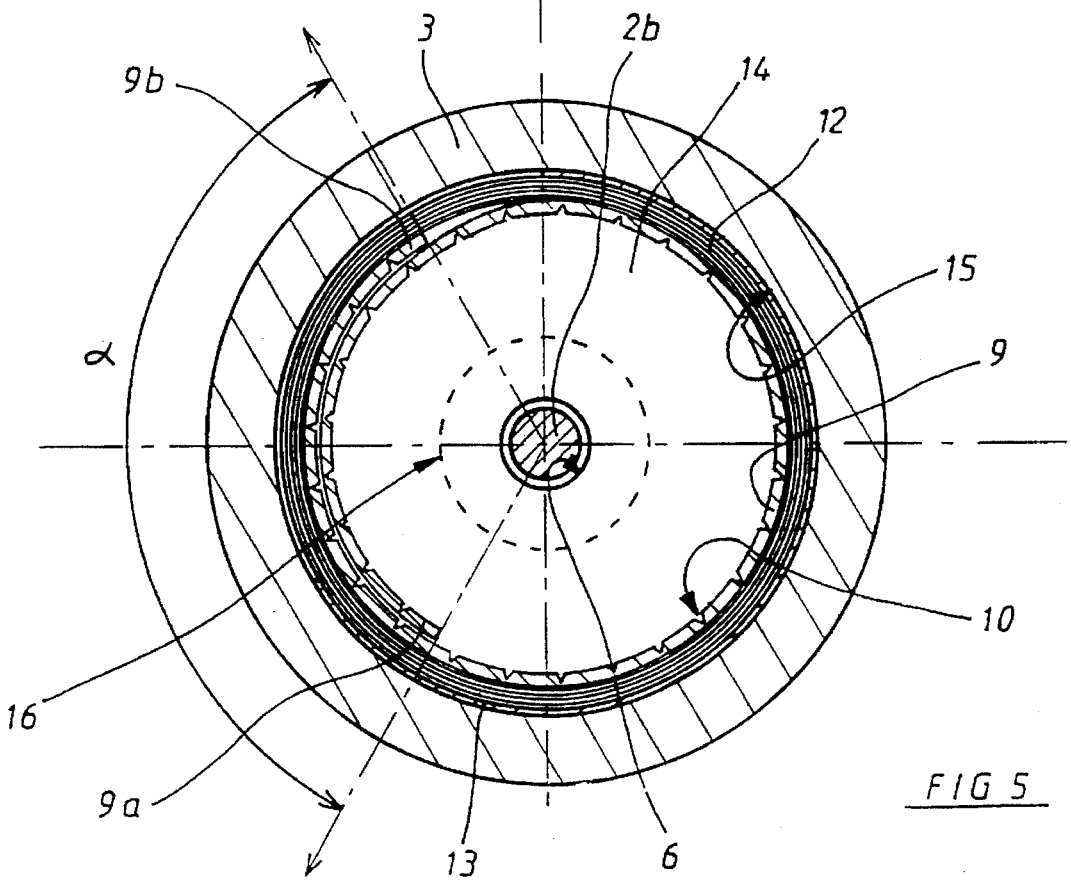
FIG. 5 shows this variant with the device shown in the unlocked position.

FIGS. 4 and 5 show a variant of construction which differs from the device described with reference to FIGS. 2 and 3 only in the orientation of the strip 9.

In this variant the strip 9 is wound on the shank **2*b* of the firing pin 2 with its grooves 10** facing inwards, i.e., towards the firing pin.

Such as arrangement improves the contact between the strip and the spiral spring when the strip winds on the spiral spring during firing. In fact, it is the smooth face of the strip 9 which comes into contact with the spiral spring. In this way, the spiral spring is more securely held against the inside cylindrical surface 15.

As a variant, it is possible to define a strip without grooves. The material will be chosen in such a way as to produce a strip exerting no elastic return force towards the firing pin but having, nevertheless, a certain rigidity along the direction of the center line 11 of the device, in order to ensure locking of the firing pin.

For example, it is possible to define a brass strip 0.4 mm in thickness.

The material of the strip may be chosen such that under the action of the centrifugal force, it undergoes plastic deformation enabling it to be held in the unlocking position shown in FIGS. 3 and 5.

Figure 6:
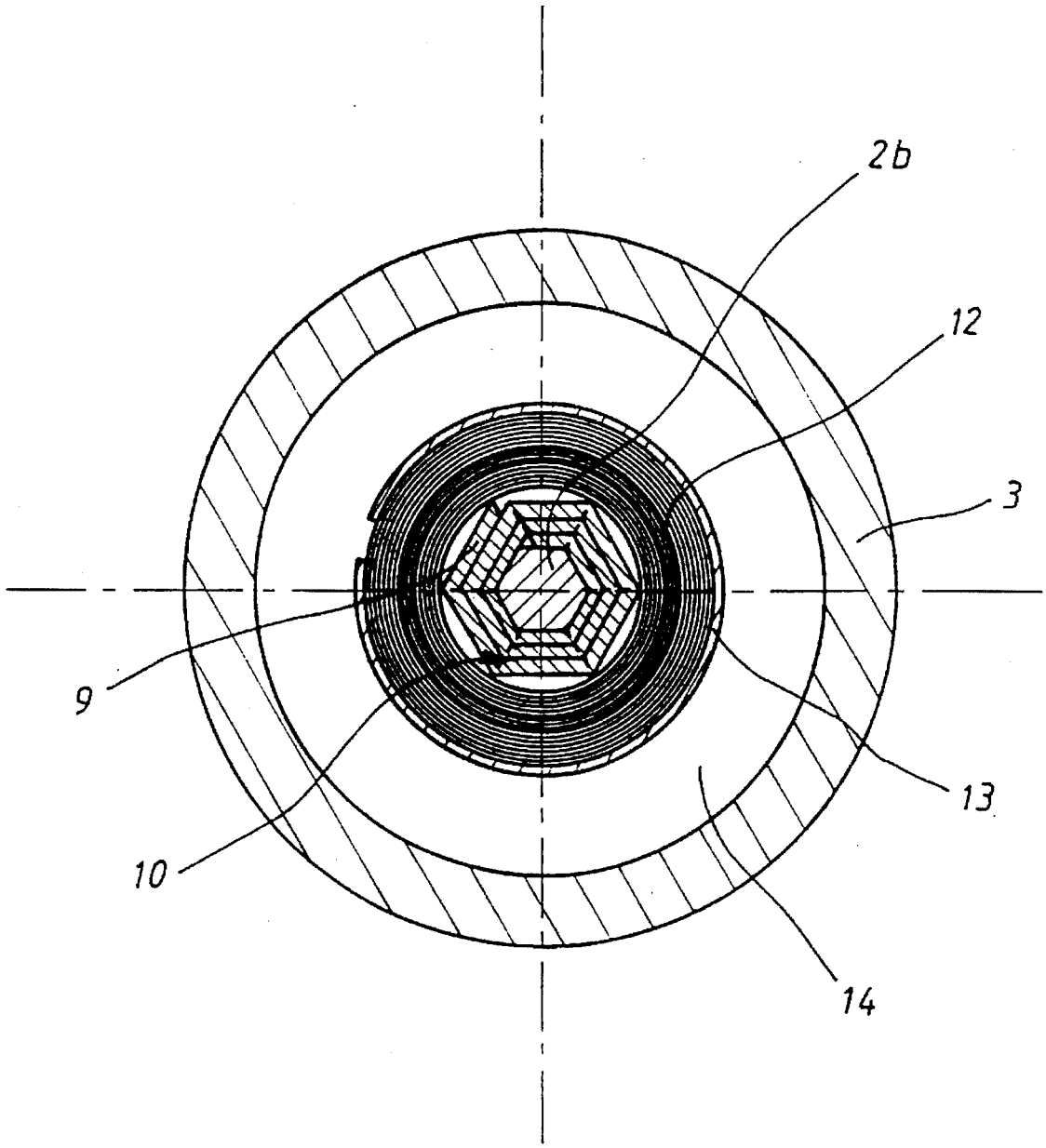
FIG. 6 is a transverse section of a second embodiment of the invention in the safe position.

FIG. 6 shows a transverse section of a second embodiment of the invention in the safe position.

In this method of construction, the shank **2*b* of the firing pin 2 has a hexagonal section. The strip 9 has grooves 10 which face inwards, i.e., towards the shank 2*b*** of the firing pin, and which are positioned at the corners of the hexagon.

The different grooves 10 on the strip 9 are made with a variable pitch which allows the strip 9 to be wound around the shank **2*b***.

Thus, the groove separation is constant for the first six grooves, allowing a first layer of the strip to be wound around the six sides of the firing pin shank. The pitch then increases for the next six grooves by an amount proportional to the thickness of the strip 9, allowing a second layer of the strip 9 to be wound around the hexagon formed by the first layer. The pitch then increases similarly for the following layers.

The total length of the strip is chosen as described above so as to ensure overlap of its ends when after firing it is wound over the spiral spring by the action of centrifugal force.

Such a method of construction allows, as described above, the spiral spring to be satisfactorily retained because of the contact of the smooth surface of the strip upon it.

It also enables the strip to be wound satisfactorily upon the firing pin shank and to maintain angular integrity of these two elements, which improves the ability of the device to withstand vibration.

In this case, however, the firing pin will be fitted so that it is free to rotate in the fuse so as to facilitate the unwinding of the spiral.

Correct winding also makes it possible to avoid the strip and firing pin from being out of true which would be likely to cause out-of-balance forces which have an adverse effect on the correct operation of the fuse.

The winding of the spiral during assembly of the device is also facilitated by the angular link between the strip and the firing pin.

As an example for a 30 mm caliber projectile, it is possible to adopt a brass strip 3 mm wide and 0.4 mm thick with grooves 0.3 mm deep.

Four turns of this strip are wound on a hexagonal firing pin shank (width of each face: 1.6 mm) and, which receives a spiral spring 1 m long.

When, after firing, the spiral is pressed against the cylindrical wall of the recess (diameter 14 mm), the ends of the strip overlap by an amount subtending an angle of 10° at the center.

As a variant, it is of course possible to define a firing pin with polygonal section on which will be wound a strip for which the variable pitch of the grooves will be selected according to the number of faces of the polygon.

Figure 7:
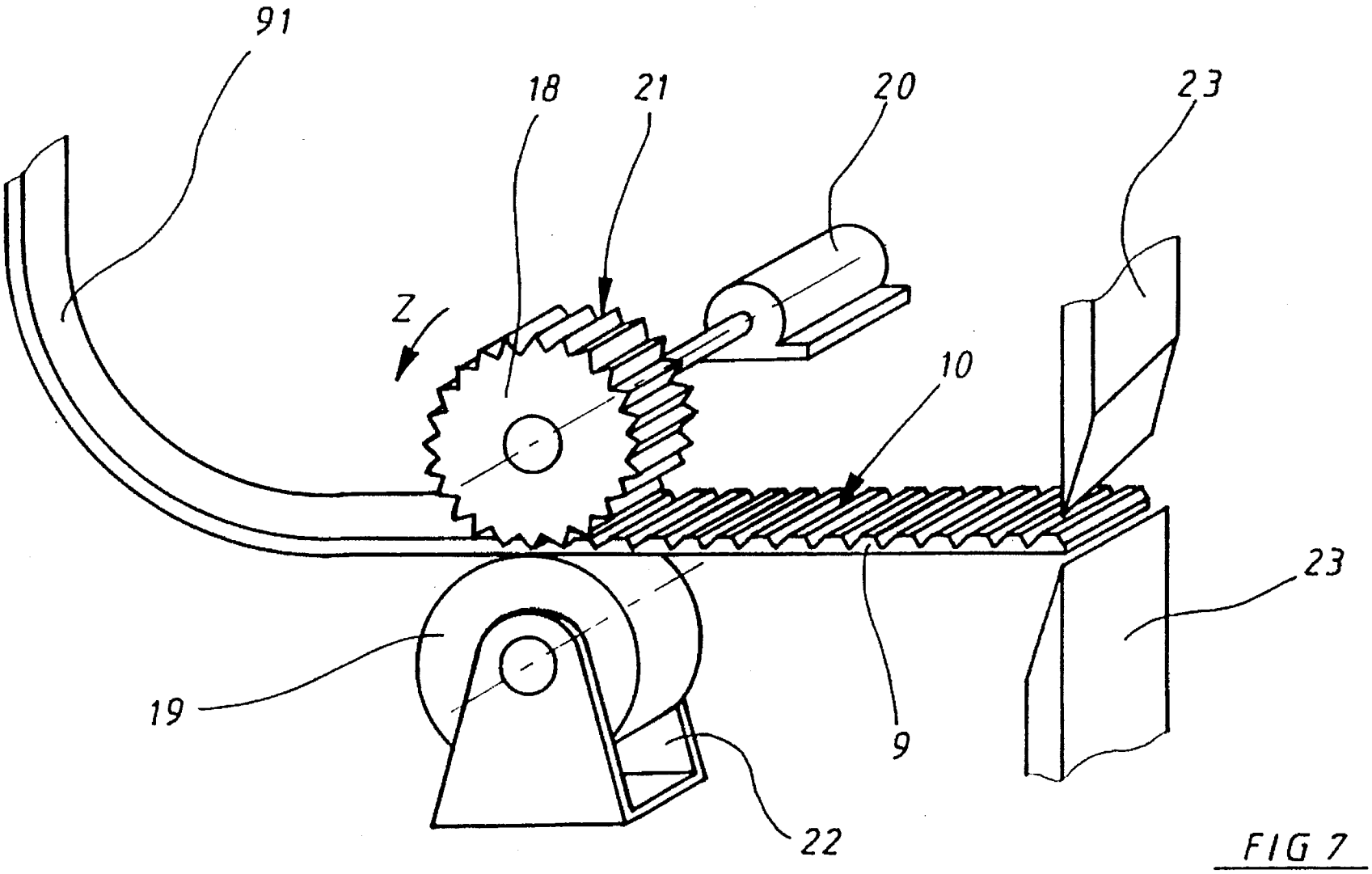
FIG. 7 shows one stage in the production of the flexible strip used in the first embodiment of the invention.

FIG. 7 is a schematic illustration of one stage in the production of the flexible strip which is used in the embodiments shown in FIGS. 2–5.

The basic strip 91 is unwound from a coil (not shown). It passes between a knurling wheel 18 and a backing pulley 19. The knurled wheel is made of steel, and is driven in the direction Z by a motor 20 and not only pulls the basic strip 91 but also produces the grooves 10 on the basic strip 91.

For this purpose, the wheel 18 has teeth 21 of triangular profile, the length of which is greater than or equal to the width of the strip 9 and whose separation determines the pitch of the grooves 10.

The backing pulley spins free on the bearings 22, the gap between the backing pulley and the knurled wheel can be varied in order to adjust the depth of the grooves 10.

The backing pulley 19 has a width greater than or equal to that of the strip, and is covered with rubber in order to secure the strip and prevent any relative slip.

The strip 9 on which the grooves 10 are made is then cut to the desired length by the blades 23, whose operation is known.

This method of construction also makes it possible to give the strip a bow orientated towards the knurled wheel, which facilitates its subsequent winding on the firing pin.

Figure 8:
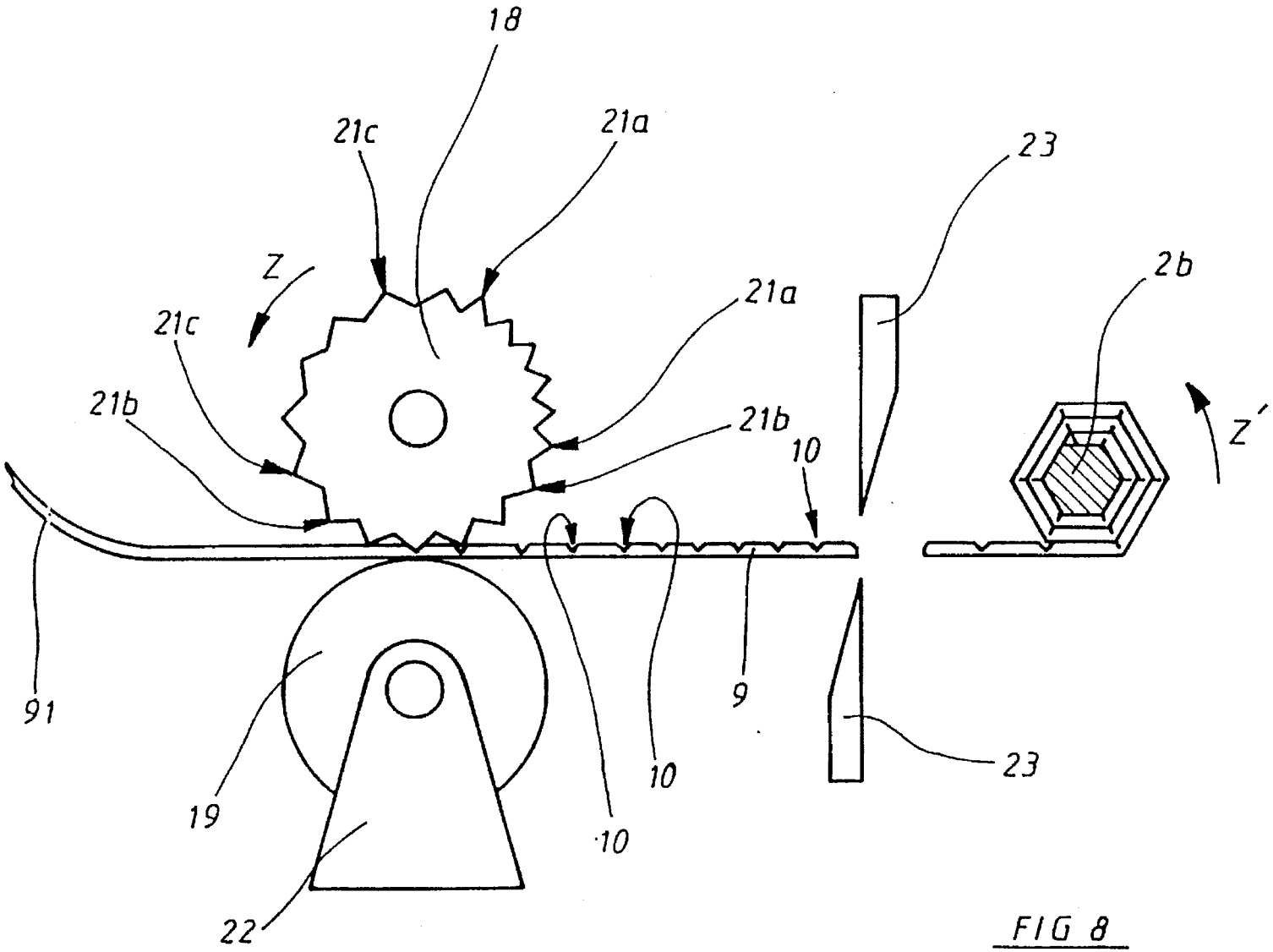
FIG. 8 shows one stage in the production of the flexible strip used in the second embodiment of the invention.

FIG. 8 shows schematically one stage in the production of the flexible strip which is used in the method of construction of FIG. 6.

The basic strip 91 passes between the knurled wheel 18 and the backing pulley 19. The knurled wheel is again driven in the direction Z by a motor 20 which pulls the basic strip 91 and produces the grooves 10.

The backing pulley 19 spins free on the bearings 22, the gap between the backing pulley and the knurled wheel being adjustable.

In this embodiment, the knurled wheel has teeth 21 of varying pitch. Thus, it has 6 first teeth 21*a*, relatively close to one another and separated at a constant first pitch.

These first teeth are followed by 6 second teeth 21*b*, slightly farther apart from one another at a constant second pitch.

The second teeth are then followed by 6 third teeth 21*c*, again farther apart from one another at a constant third pitch.

The set of teeth 21*a*, 21*b* and 21*c* makes it possible to produce on the basic strip 91 grooves whose variable pitch allows the strip 9 to be wound on a hexagonal shank as previously described. The strip 9 is then cut to the desired length by the blades 23.

According to a variant of this process, the strip 9 can be pulled by means of a hexagonal shaft on which the formed strip is wound.

This hexagonal shaft will preferably consist of the shank 2*b* of the firing pin 2, driven in rotation in the direction Z' by a motor (not shown).

There is then no need to provide a motor to drive the knurled wheel.

The advantage of this process is that it produces a firing pin 2 fitted with its locking strip 9 with the strip wound on the firing pin to a predetermined tightness directly.

To adjust the tightness, it will be sufficient to modify the tension of the strip 9 by varying the torque of the motor driving the firing pin and the resisting torque of the backing pulley or the knurled wheel (fitted with adjustable brakes).

We claim:

1. A safety device to lock a firing pin of a spin-stabilized projectile fuse, said safety device comprising:

a flexible strip disposed around said firing pin, said flexible strip having a first end, a second end, and a length, wherein said flexible strip is in contact with the firing pin in a wound position; and a spiral spring made of an elastic material and windable around said flexible strip in a safe position and disposed to unwind under centrifugal force to a firing position, said spiral spring being made of a spring strip that is wound around itself, wherein when said spiral spring unwinds, said flexible strip unwinds within said spiral spring, and wherein said length of said flexible strip is dimensioned such that said first end overlaps said second end by an offset amount when said flexible strip presses against said spiral spring in said firing position.

2. The safety device of claim 1, wherein said flexible strip includes grooves.

3. The safety device of claim 2, wherein said grooves are disposed in a side of said flexible strip that faces said firing pin.

4. The safety device of claim 1, wherein said firing pin is approximately cylindrical.

5. The safety device of claim 3, wherein said firing pin has an approximately polygonal shape and said grooves are spaced along said length of said flexible strip at a variable pitch in accordance with said polygonal shape.

6. The safety device of claim 3, wherein said firing pin has an approximately hexagonal shape having corners, and wherein said grooves are spaced along said length to be alignable with said corners of said hexagonal shape when said flexible strip is wound around said firing pin.

7. The safety device of claim 1, wherein said offset amount between said first end and said second end of said flexible strip is between approximately 60° and approximately 180°.

8. The safety device of claim 1, wherein said offset amount between said first end and said second end of said flexible strip is approximately 120°.

9. A method of making a safety device to lock a firing pin of a spin-stabilized projectile fuse, said method comprising:

winding a flexible strip around said firing pin, said flexible strip having a first end, a second end and a length, said flexible strip contacting the firing pin in a safe position;

winding a spring strip into a spiral spring around said flexible strip such that said spiral spring is disposed to unwind from a safe position to a firing position under centrifugal force, wherein when said spiral spring unwinds, said flexible strip unwinds within said spiral spring; and dimensioning said length of said flexible strip such that said first end overlaps said second end by an offset amount when said flexible strip presses against said spiral spring in said firing position.

10. The method of claim 9, further comprising producing grooves in said flexible strip by knurling a smooth strip between a knurling wheel and a backing pulley.

11. The method of claim 10, wherein said step of producing grooves includes knurling said smooth strip with a knurling wheel having a variable pitch.

12. The method of claim 10, wherein said step of producing grooves includes pulling said flexible strip between a knurling wheel and a backing pulley with a rotating polygonal shaft and winding said strip around said polygonal shaft.

13. A spin-stabilized projectile fuse having a safety device for locking a firing pin, said safety device comprising:

a flexible strip disposed around said firing pin, said flexible strip having a first end, a second end and a length, wherein said flexible strip is in contact with the firing pin in a wound position; and a spiral spring made of an elastic material windable around said flexible strip in a safe position and disposed to unwind under centrifugal force to a firing position, said spiral spring being made of a spring strip that is wound around itself, wherein when said spiral spring unwinds, said flexible strip unwinds within said spiral spring without exerting an elastic return force toward said firing pin, and wherein said length of said flexible strip is dimensioned such that said first end overlaps said second end by an offset amount when said flexible strip presses against said spiral spring in said firing position.

14. The spin-stabilized projectile fuse of claim 13, wherein said flexible strip includes grooves.

15. The spin-stabilized projectile fuse of claim 14, wherein said grooves are disposed in a side of said flexible strip that faces said firing pin.

16. The spin-stabilized projectile fuse of claim 14, wherein said firing pin is approximately cylindrical and is disposed not to rotate relative to said spin-stabilized projectile fuse.

17. The spin-stabilized projectile fuse of claim 15, wherein said firing pin is disposed to rotate freely and has an approximately polygonal shape, said grooves being spaced along said length of said flexible strip at a variable pitch in accordance with said polygonal shape.

18. The spin-stabilized projectile fuse of claim 15, wherein said firing pin is disposed to rotate freely and has an approximately hexagonal shape having corners, said grooves being spaced along said length to be alignable with said corners of said hexagonal shape when said flexible strip is wound around said firing pin.

19. The spin-stabilized projectile fuse of claim 13, wherein said offset amount between said first end and said second end of said flexible strip is between approximately 60° and approximately 180°.

20. The spin-stabilized projectile fuse of claim 14, wherein said offset amount between said first end and said second end of said flexible strip is approximately 120°.

* * * * *